US008430285B2

(12) United States Patent
Burnsed, Jr.

(10) Patent No.: US 8,430,285 B2
(45) Date of Patent: Apr. 30, 2013

(54) SYSTEMS, METHODS AND APPARATUS FOR SUPPORTING A FIREARM FROM A PERSON

(75) Inventor: Ashley A. Burnsed, Jr., Port Wentworth, GA (US)

(73) Assignee: Blue Force Gear, Inc., Savannah, GA (US)

( * ) Notice: Subject to any disclaimer, the term of this patent is extended or adjusted under 35 U.S.C. 154(b) by 208 days.

(21) Appl. No.: 11/950,238

(22) Filed: Dec. 4, 2007

(65) Prior Publication Data

US 2008/0302838 A1 Dec. 11, 2008

Related U.S. Application Data

(60) Provisional application No. 60/868,484, filed on Dec. 4, 2006.

(51) Int. Cl.
*F41C 33/00* (2006.01)

(52) U.S. Cl.
USPC ..... 224/150; 24/198

(58) Field of Classification Search ..... 224/149, 224/150, 600; 42/85; 24/197, 198, 200
See application file for complete search history.

(56) References Cited

U.S. PATENT DOCUMENTS

| | | | | | |
|---|---|---|---|---|---|
| 2,812,123 | A * | 11/1957 | Girton | 224/150 |
| 4,511,070 | A * | 4/1985 | Hightower | 224/150 |
| 5,082,155 | A * | 1/1992 | Salvador | 224/150 |
| 5,246,154 | A | 9/1993 | Adams et al. | |
| 5,282,558 | A | 2/1994 | Martinez | |
| 5,810,219 | A * | 9/1998 | Rosenfield | 224/150 |
| 6,068,167 | A * | 5/2000 | Hopson | 224/150 |
| 6,520,390 | B2 | 2/2003 | Verdugo et al. | |
| 6,681,973 | B2 * | 1/2004 | Crumrine | 224/637 |
| 6,932,254 | B2 * | 8/2005 | Eliason | 224/150 |
| 7,059,502 | B2 | 6/2006 | Johnson | |
| 7,069,624 | B2 | 7/2006 | Johnson | |
| D577,093 | S * | 9/2008 | White et al. | D22/108 |
| 2002/0020724 | A1 | 2/2002 | Lindsey | |
| 2004/0188476 | A1 * | 9/2004 | Johnson | 224/150 |
| 2008/0217371 | A1 * | 9/2008 | Wemmer | 224/579 |

OTHER PUBLICATIONS

The 2P: A Combat Tactical Sling System for the 21st Century <http://www.redi-mag.com/2psling.php>, Retrieved Aug. 14, 2008.

* cited by examiner

*Primary Examiner* — Nathan J Newhouse
*Assistant Examiner* — Adam Waggenspack
(74) *Attorney, Agent, or Firm* — Sutherland Abill & Brennan LLP

(57) ABSTRACT

Embodiments of the invention can provide systems, methods, and apparatus for supporting a firearm from a person can be provided. For example, in one embodiment, a sling system for an object, such as a firearm or weapon, can be provided. The sling system can include a sling operable to mount an object to a portion of a person's body, wherein the sling comprises at least one adjustment loop. The sling system can also include an adjuster mounted to a portion of the at least one adjustment loop. Furthermore, the sling system can include a quick tab adjuster operable to change the size of the at least one adjustment loop, wherein the length of the sling can be changed when the sling is mounted to a portion of a person's body.

17 Claims, 7 Drawing Sheets

SYSTEMS, METHODS AND APPARATUS FOR SUPPORTING A FIREARM FROM A PERSON

RELATED APPLICATION

This application relates to and claims the benefit on U.S. Provisional Application No. 60/868,484, entitled "Systems and Methods for Supporting a Firearm from a Person," filed Dec. 4, 2006, the entire contents of which are hereby expressly incorporated by this reference.

FIELD OF THE INVENTION

The invention relates generally to the field of firearms, and more particularly, relates to systems, methods, and apparatus for supporting a firearm from a person.

BACKGROUND OF THE INVENTION

Conventional systems and methods for supporting a firearm from a person, typically a type of sling, are often relatively complicated and may be difficult to use. In some instances, a user must learn complicated routines for using a conventional sling. Other types of slings are not relatively easy to wear, and can also be difficult to remove from a user's body. Because removal from the user's body may also be relatively slow, conventional slings may be detrimental to the user in combat or other dangerous situation, particularly when the user desires to remove the sling and associated firearm from his or her body. Likewise, other types of slings can interfere with a user's movement and could negatively impact a user's response time in a combat or hunting situation, especially should an emergency or rapid response condition arise. Furthermore, some conventional firearm slings can become uncomfortable to wear, which may result in fatigue, thus reducing the user's reaction time in emergency, combat, rapid response situations or conditions.

Therefore, a need exists for systems and methods for supporting an object, such as a firearm, from a person.

A further need exists for a sling system and apparatus for supporting an object, such as a firearm, from a person, in which the sling can include a two-point design to enable the user to position the object or firearm in a variety of carry and/or shooting positions.

Yet a further need exists for a sling system and apparatus for supporting an associated object or firearm from a person, particularly for an object or firearm with a front and rear side sling swivel.

Additionally, a further need exists for a sling system and apparatus with relatively quick adjustment capability for relatively easier adjustment and/or removal when supporting an associated object or firearm from a person.

A further need exists for methods associated with a sling system and apparatus for supporting an object or firearm from a person.

SUMMARY OF THE INVENTION

Embodiments of the invention can address some or all of the above needs. Embodiments of the invention can provide systems, methods, and apparatus for supporting a firearm from a person can be provided. For example, in one embodiment, a sling system for an object, such as a firearm or weapon, can be provided. The sling system can include a sling operable to mount a weapon to a portion of a person's body, wherein the sling comprises at least one adjustment loop. The sling system can also include an adjuster mounted to a portion of the at least one adjustment loop. Furthermore, the sling system can include a quick tab adjuster operable to change the size of the at least one adjustment loop, wherein the length of the sling can be changed when the sling is mounted to a portion of a person's body.

In another embodiment, a method for mounting an object to a person's body, wherein the object can be transitioned by the person to another portion of the person's body, can be provided. The method can include providing a sling comprising an adjustment loop and a quick tab adjuster. The method can also include mounting the sling to an object. Furthermore, the method can include mounting the object to a person's body using the sling, wherein at least a portion of the person's body is between the sling and the object. In addition, the method can include adjusting the length of the sling by manipulating the quick tab adjuster and changing the size of the adjustment loop.

In another embodiment, an apparatus for a sling system can be provided. The apparatus can include an adjuster operable to mount to an adjustment loop associated with a sling. Furthermore, the apparatus can include a quick tab adjuster operable to mount to a portion of the adjuster, wherein manipulating the quick tab adjuster can manipulate the adjuster to change the size of the adjustment loop.

In yet a further embodiment, a sling system for mounting an object to a person's body an be provided. The sling system can include a sling operable to mount an object to a portion of a person's body. The sling can include a forearm end operable to mount to a forearm end of the object, a buttstock end operable to mount to a buttstock end of the object, and an intermediate portion with at least one adjustment loop. The sling system can also include an adjuster mounted to a portion of the at least one adjustment loop. Furthermore, the sling system can include a quick tab adjuster operable to change the size of the at least one adjustment loop, wherein the length of the sling can be changed when the sling is mounted to a portion of a person's body.

In an additional embodiment, a sling system for an object can be provided. The sling system can include a sling operable to mount an object to a portion of a person's body. The sling can include a forearm end operable to mount to a swivel associated with a forearm end of the object, a buttstock end operable to mount to a swivel associated with a buttstock end of the object, and an intermediate portion operable to form the at least one adjustment loop.

Other systems, processes, and apparatus according to various embodiments of the invention will become apparent with respect to the remainder of this document.

DETAILED DESCRIPTION OF EMBODIMENTS OF THE INVENTION

As used herein, the term "object" can mean any device including, but not limited to, a weapon, firearm, briefcase, luggage, or any other device that may be carried by a person or user. Embodiments of the invention are not intended to be limited to any particular object, and can be implemented with any object in accordance with various embodiments of the invention.

Various embodiments of the invention can provide systems, methods, and apparatus for supporting a firearm from a person. One example of a sling in accordance with an embodiment of the invention is known as the "Vickers Combat Applications Sling™," which will be manufactured and distributed by Blue Force Gear, Inc. of Savannah, Ga.

Figure 1:
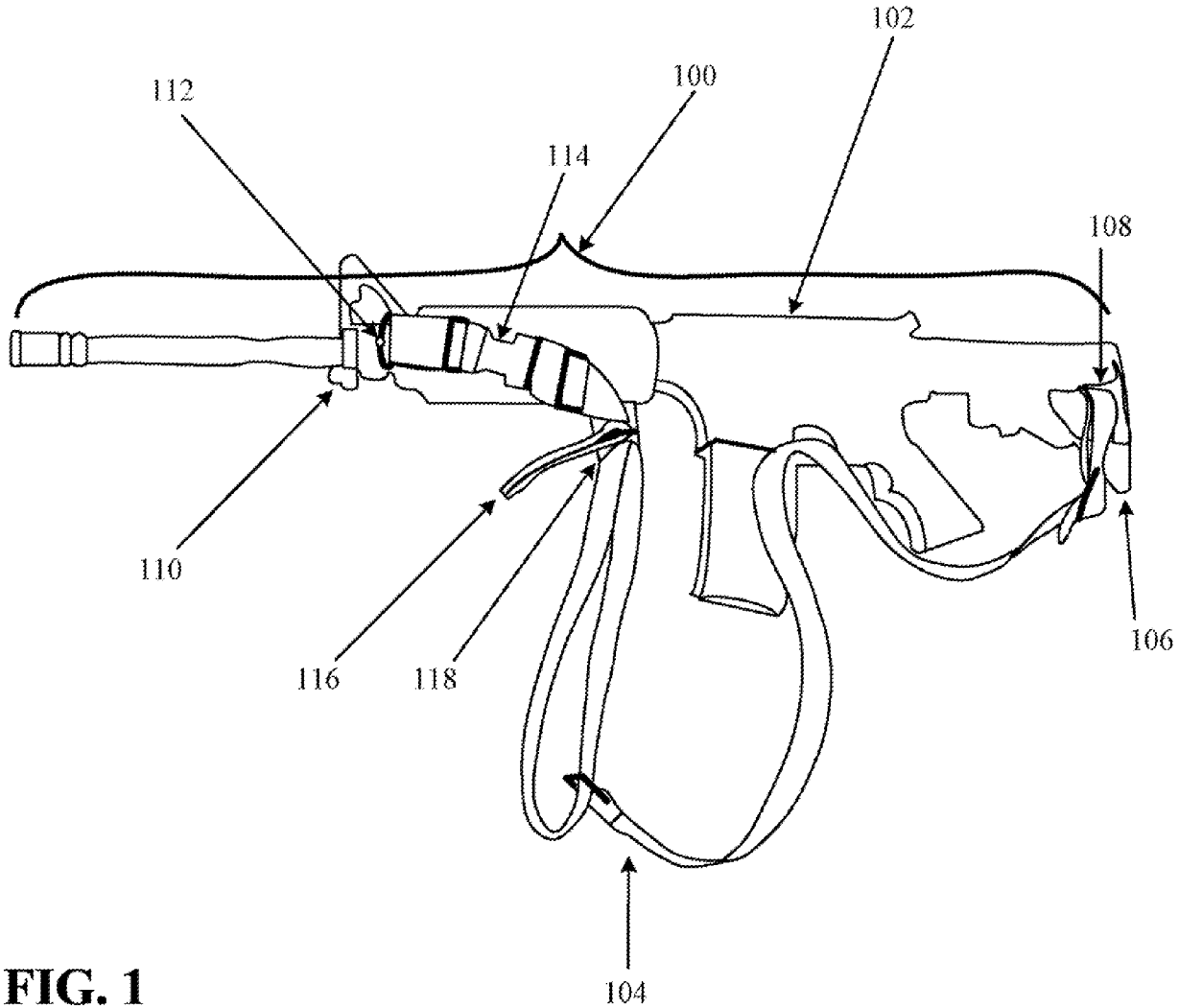
FIG. 1 is a perspective assembly view of an example system for providing a sling for supporting an associated firearm, such as an M-4 Carbine, from a person in accordance with an embodiment of the invention.
Figure 9:
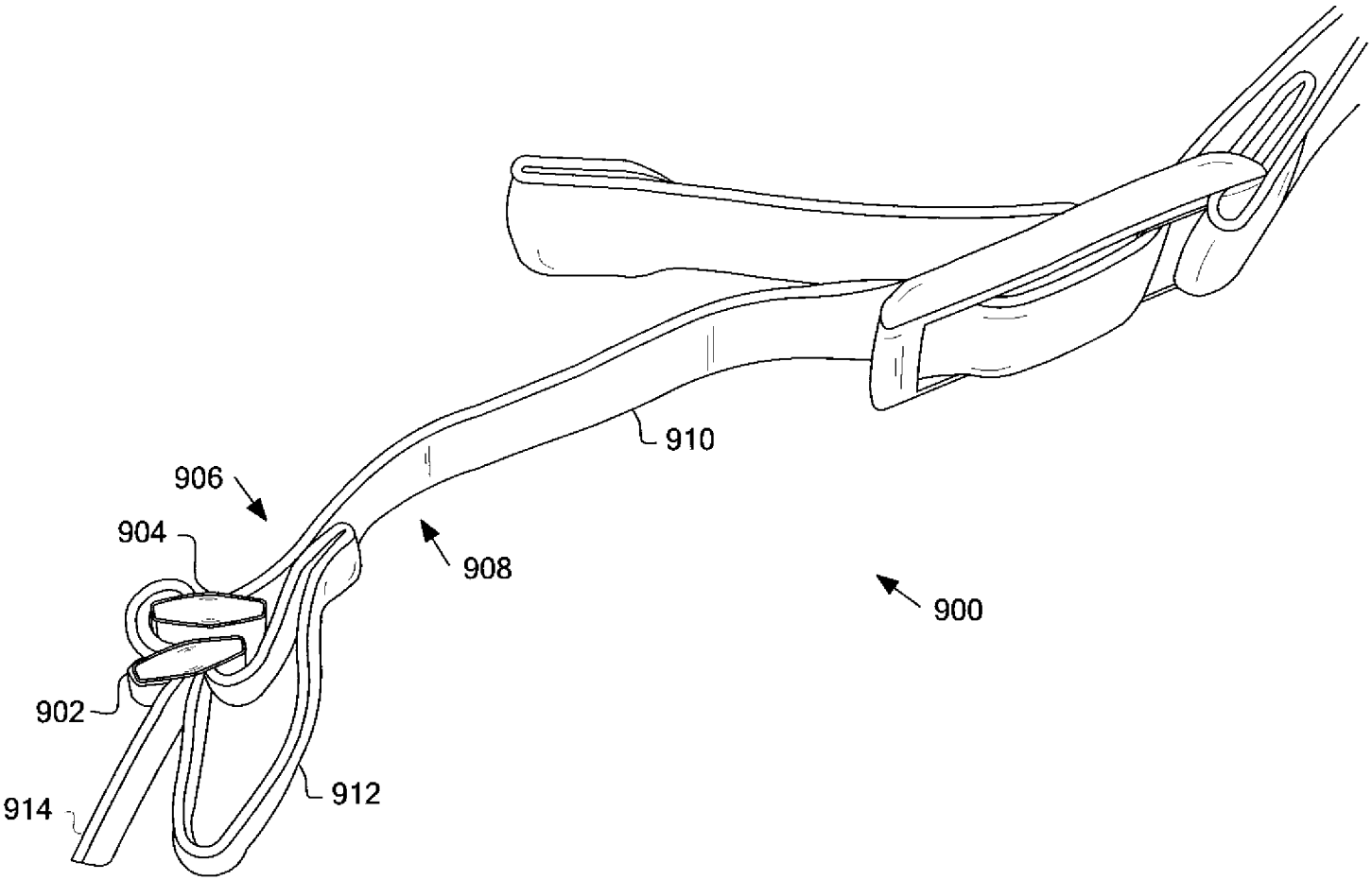
FIG. 9 illustrates an example mounting device for mounting a sling to a weapon or firearm in accordance with an embodiment of the invention.

FIG. 1 is a perspective view of an example assembled sling system 100 for supporting a firearm 102 from a person. The embodiment shown in FIG. 1 provides a user, such as a tactical or skilled shooter, with a sling system for supporting a firearm, such as a M-4 Carbine, from a person. The sling system 100 can include a sling 104 which can mount to the associated firearm 102. The example firearm shown in FIG. 1 is a M-4 Carbine, and could be another type of firearm or weapon. As shown in FIG. 1, the sling 104 can mount to both a portion of a buttstock end 106 of the firearm 102 at a rear swivel 108 and to a portion of a forearm end 110 of the firearm 102 at a forward swivel 112. The buttstock end 106 of the sling 104 is shown mounted to a loop, or rear swivel 108, and the forearm end 110 of the sling 104 is shown mounted to a loop mounted to the forearm end 110 of the firearm 102. Such loops and swivels can be manufactured or otherwise integrated on particular weapons or firearms, such as a M4 Carbine, and mounted to a sling in accordance with an embodiment of the invention. In other embodiments, other loops, swivels, or other mounting devices can be mounted or otherwise integrated with various parts of other firearms and/or weapons in order to facilitate mounting of a sling to the firearm or weapon. In one example, if an embodiment of a sling is contemplated to be used with a weapon or firearm without a front and rear swivel, then one or more adapters or mounting devices can be used to mount the sling to the weapon or firearm. In another example, a "double loop lock" as shown and described in FIG. 9 can be used to mount a sling to either end of a weapon or firearm. The double loop lock 900 shown in FIG. 9 can be implemented at either end of a sling, for instance, a forearm end 110 of the sling 104. At least two single loop connectors 902, 904 can be mounted to a loop 906 formed adjacent to an end 908 of a strap 910. A second strap 912 can be mounted adjacent to the end 908 of the strap 910, and an extended portion 914 of the second strap 912 can be threaded through the first loop connector 902 and second loop connector 904 adjacent to the loop 906 adjacent the end 908 of the strap 910. The extended portion 914 can then be threaded back through a portion of the first loop connector 902 such that the second strap 912 overlaps itself adjacent to the first loop connector 902. The double loop lock 900 can be mounted to a sling by way of a buckle connector 916, or could be integrated at the end of a sling, such as 104. In any instance, a double loop lock 900 can be formed for use in mounting the sling 910 to either end of a weapon or firearm. Other configurations and components for a double loop lock can exist in accordance with other embodiments of the invention.

Figure 6A:
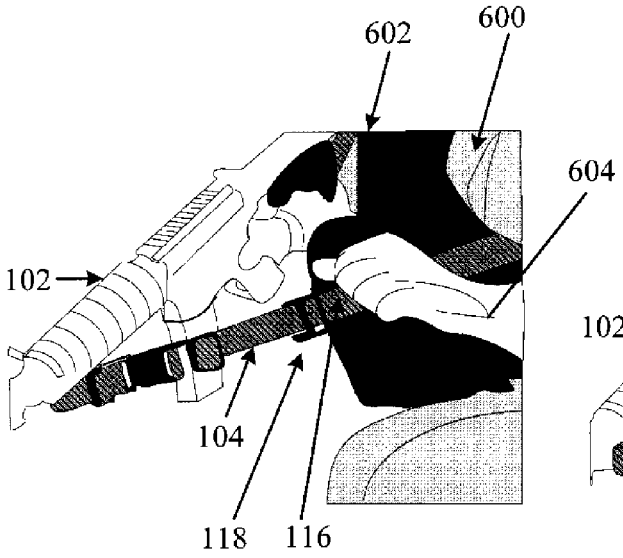
FIG. 6*a* illustrates an example loosening procedure for the sling of FIG. 2 in accordance with an embodiment of the invention.
Figure 6B:
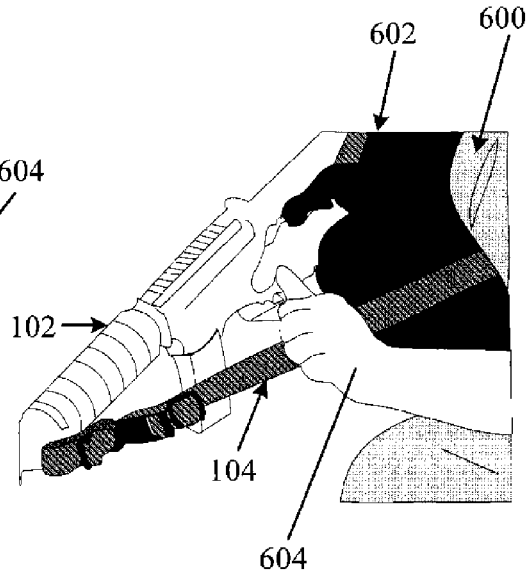
FIG. 6*b* illustrates an example tightening procedure for the sling of FIG. 2 in accordance with an embodiment of the invention.
Figure 7:
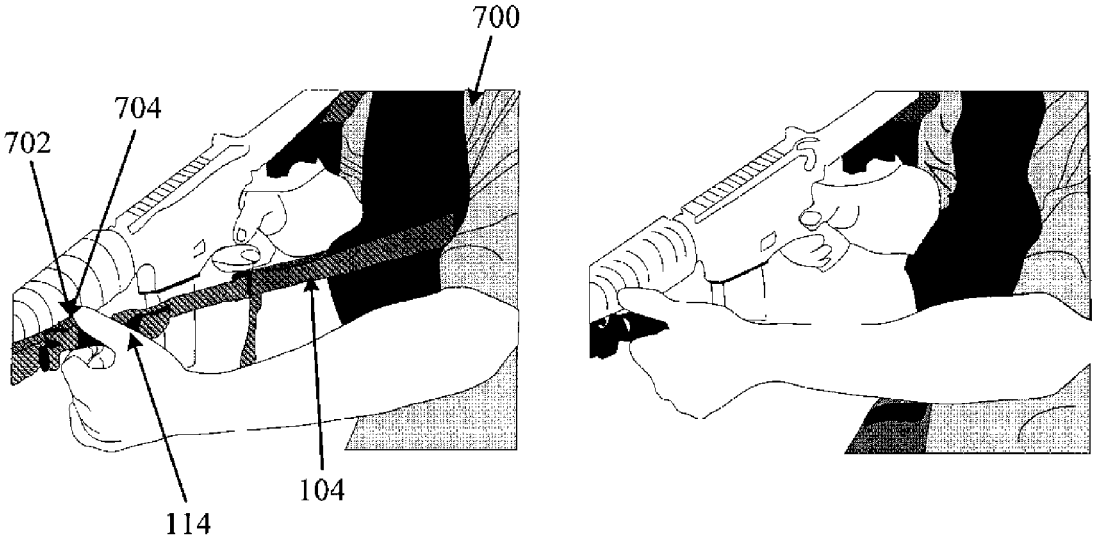
FIGS. 7*a*-7*b* illustrate an example disconnect procedure for the sling shown in FIG. 1 in accordance with an embodiment of the invention.

In one embodiment of the invention, adapters can be used to mount a M16A2 series semiautomatic firearm to a sling. Such adapters can include, but are not limited to, an A2 Buttstock adapter band, which will be available from Blue Force Gear, Inc. of Savannah, Ga. Further, a weapon or firearm without a front swivel may use an adapter, such as a XX-FB modular forearm end adapter, which will also be available from Blue Force Gear, Inc. to mount a sling to the weapon or firearm in accordance with an embodiment of the invention. Other suitable mounting devices for mounting a weapon or firearm to a sling are described in U.S. Ser. No. 11/153,717. Referring back to the sling system 100 shown in FIG. 1, a user can utilize the sling 104 by inserting a portion of his or her shoulder and head between the sling 104 and the firearm 102, such that a portion of the sling 104 can be supported from the user's neck and/or shoulder, and the firearm 102 can be supported between the user's arm and corresponding shoulder. Examples of this orientation are shown in FIGS. 6*a*-*b*, and 7*a*. As needed, the user can switch the position of the firearm 102 to either shoulder of the user's body without having to take the sling 104 off the firearm 102, without having to adjust the sling 104 and/or without entangling the sling 104 with a portion of the user's body during movement or transition of the firearm 102.

As shown in the embodiment of FIG. 1, and described in greater detail below, the sling 104 can include a removable modular release-type buckle 114, such as a Fastex® Side Release Buckle, a quick adjust tab 116, and an adjuster 118 for increasing or decreasing the length of the sling 104. These components 114, 116, 118 can be used in combination with each other to rapidly adjust the sling 104 with respect to a user's body and/or firearm 102 or otherwise disengage the sling 104 from the firearm 102. Other embodiments of a sling system, such as 100, can include any number of components, including 104, 108, 112, 114, 116, and 118, in similar or different configurations to support a firearm or weapon from a person. For example, in one embodiment, the removable modular release-type buckle 114 can be replaced with a connection-type device that can connect the forearm end 200 of the sling 104 with an intermediate portion of the sling 104.

In the embodiment shown, the sling system 100 can be configured to include at least one quick adjust tab, similar to 116, which can be utilized with an associated adjuster, similar to 118, the combination which can be adjusted towards a buttstock end 106 of the firearm 102 to either increase or decrease the length of a sling 104. In another embodiment, a quick adjust tab, similar to 116, and adjuster, such as 118, can both be adjusted away from the buttstock end 106 of the firearm 102, to either increase or decrease the length of a sling 104.

Figure 2:
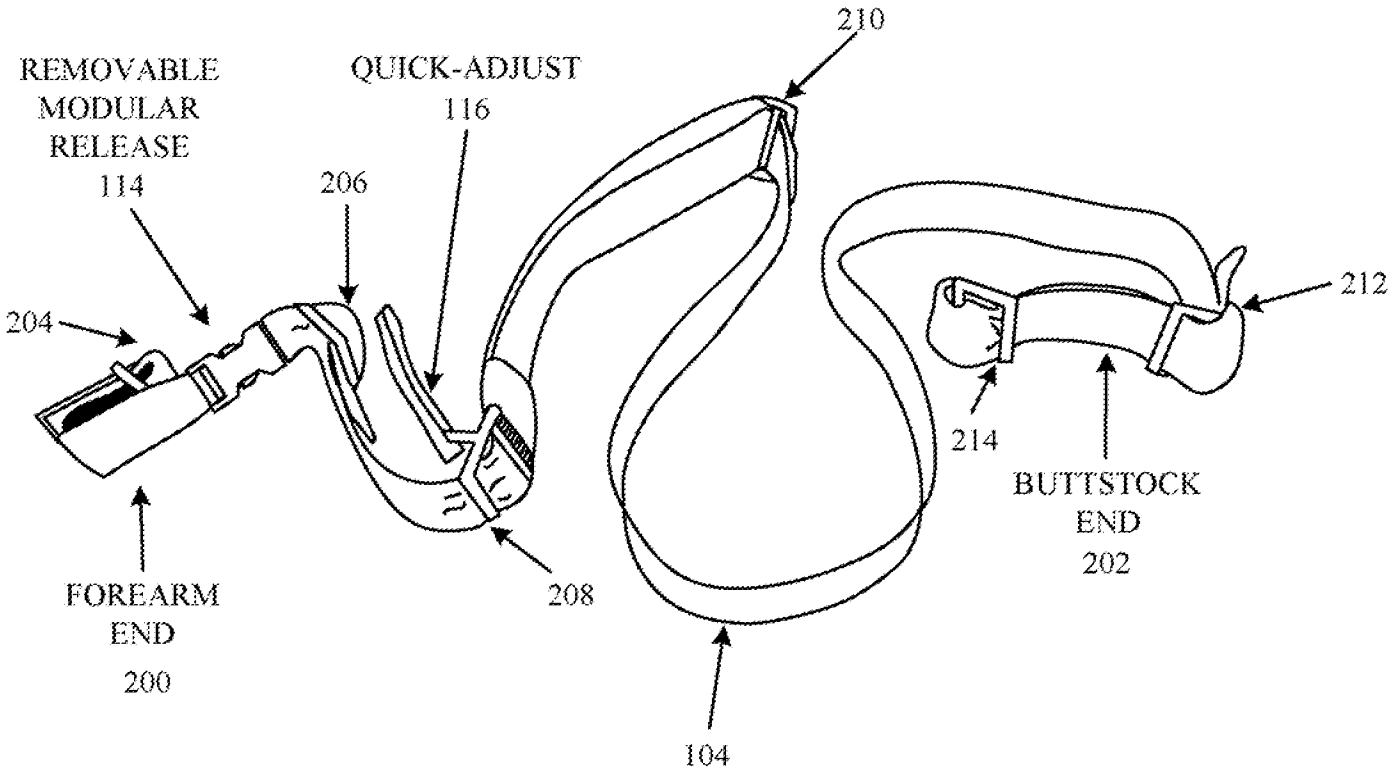
FIG. 2 is a perspective view of the sling depicted in FIG. 1, shown apart from an associated firearm.

FIG. 2 is a perspective view of the sling 104 shown in FIG. 1, and is shown apart from the associated firearm 102. The sling 104 shown in FIGS. 1 and 2 can include a forearm end 200 and a buttstock end 202. The sling 104 can be made from one or more component loops of material and connected together with various buckles or other devices, or the sling 104 can be made from a single piece of material. In the embodiment shown, the sling 104 can be made from nylon or polypropylene. The materials used in the construction of the sling 104 should be of suitable strength and durability sufficient to permit the handling and firing of an associated firearm supported by the sling. Other embodiments of a sling can be made from any suitable strap material including, but not limited to, canvas, nylon, or polypropylene. One suitable sling can be made from a nylon strap with a primary color of coyote brown.

Embodiments of the sling 104 shown in FIG. 2 can be used with various types of objects including, but not limited to, a firearm, a weapon, a briefcase, luggage, or any device that may be carried by a person or a user. When the sling 104 is implemented with an object, such as a briefcase or luggage, the forearm end 200 and buttstock end 202 of the sling 104 can mount to suitable mounting devices or other points associated with the object to be carried. Thus, the terms "forearm end" and "buttstock end" when used to reference an object can be used interchangeably to mean respectively a "first point" and a "second point" associated with the object to which the sling will be mounted. One will recognize the mounting devices or other points associated with the object which may be used in accordance with embodiments of the invention.

Adjacent to the forearm end 200 of the sling 104 shown in FIG. 2, one or more forearm end adjustment loops 204 can be mounted to the sling 104. The forearm end adjustment loops 204 can permit adjustment of the forearm end 200 of the sling 104 adjacent to the forearm end 110 of the associated firearm 102. The forearm end adjustment loops 204 can be made from metal or plastic. One example of a suitable device for a forearm end adjustment loop is a flat-type buckle connector.

The removable modular release-type buckle 114, shown and described above in FIGS. 1 and 2 can mount adjacent to the forearm end 200 of the sling 104 and forearm end adjustment loops 204, and can separate the forearm end 200 of the sling 104 from the other portions of the sling 104, such as an intermediate portion of the sling 104 or the buttstock end 202 of the sling 104.

A forearm buckle loop 206 can mount to a portion of the sling 104 adjacent to the removable modular release-type buckle 114. The forearm buckle loop 206 can permit adjustment of the sling 104 adjacent to the removable modular release-type buckle 114. The forearm buckle loop 206 can be made from metal or plastic. One example of a suitable forearm buckle loop is a flat-type buckle connector.

The quick adjust tab 116, shown and described above in FIGS. 1 and 2 can mount to or adjacent an intermediate buckle loop or adjuster 118 and further adjacent to an intermediate portion 207 of the sling 104 via an associated adjuster 118. The quick adjust tab 116 is shown extending from the intermediate buckle loop or adjuster 118, but can be any device or mechanism mounted to an intermediate portion 207 of the sling 104 that permits a user to grasp the device or mechanism to adjust the alignment or fit of the sling 104 relative to the user's body. An example of a quick adjust tab and associated adjuster are respectively shown as 800 and 804 in FIG. 8.

The intermediate buckle loop or adjuster 118 can mount to an intermediate portion 207 of the sling 104 and can provide a mount for the quick adjust tab 116 via an associated mount 209. The intermediate buckle loop or adjuster 118 and associated mount 209 can be made from metal or plastic. An adjustment loop 208 can be formed, shown for example in the intermediate portion 207 of the sling 104, by an overlap of the sling 104 material adjacent to the intermediate buckle loop or adjuster 118.

In the embodiment shown in FIG. 2, the quick adjust tab 116, intermediate buckle loop or adjuster 118, and adjustment loop 208 can cooperate together such that when a user manipulates the quick adjust tab 116, the intermediate buckle loop or adjuster 118 can be adjusted or otherwise aligned relative to the sling 104 to facilitate lengthening or shortening of the adjustment loop 208, thereby lengthening or shortening the overall length of the sling 104 to fit or loosen the sling 104 relative to a user's body.

A second intermediate buckle loop 210 can mount to an intermediate portion 207 of the sling 104, and can also mount to the buttstock end 202 of the sling 104 such that the intermediate portion 207 and buttstock end 202 of the sling 104 can be connected. As shown in FIG. 2, the second intermediate buckle loop 210 can mount to or otherwise thread through a portion of the adjustment loop 208 formed by an overlap of the sling 104 material adjacent to the intermediate buckle loop or adjuster 118. The second intermediate buckle loop 210 can be made from metal or plastic. One example of a suitable buckle for a second intermediate buckle loop is a flat-type buckle connector. Other embodiments of a sling system, such as 100, can include similar or different configurations of a second intermediate buckle loop. For example, in one embodiment, a flat-type buckle connector can be replaced with a connection-type device that can connect the buttstock end 202 of the sling 104 with an intermediate portion of the sling 104.

One or more buttstock end buckle loops 212, 214 can mount adjacent to the buttstock end 202 of the sling 104. In the embodiment shown in FIG. 2, two buttstock end buckle loops 214 can be used to connect the buttstock end 202 portion of the sling 104 to a buttstock end, such as 106 in FIG. 1, of the associated firearm. In some embodiments, one buttstock end buckle loop 214 may be used. The buttstock end buckle loops 212, 214 can be made from metal or plastic. One example of a suitable buckle for a buttstock end buckle loop is a flat-type buckle connector.

Figure 3A:
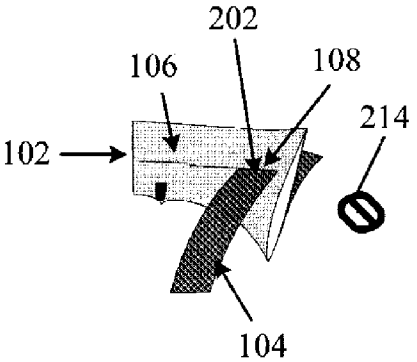
FIGS. 3*a*-3*h* illustrate an example sequence for mounting a buttstock end of the sling shown in FIG. 2 to a rear swivel located on a buttstock end of an associated firearm in accordance with an embodiment of the invention.
Figure 3B:
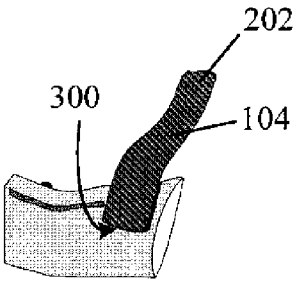
Figure 3C:
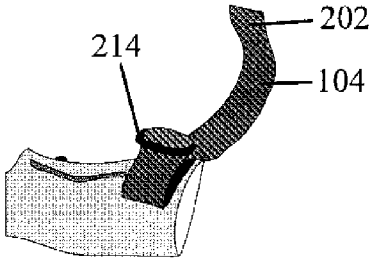
Figure 3D:
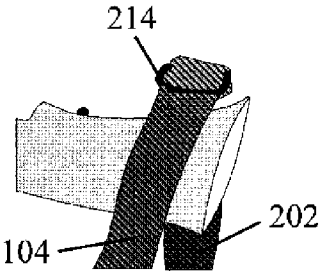
Figure 3E:
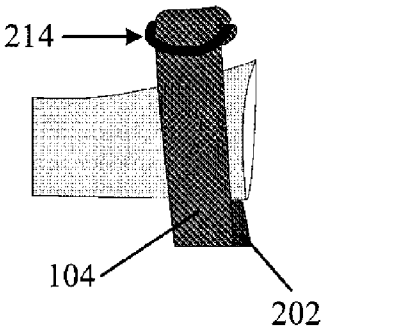
Figure 3F:
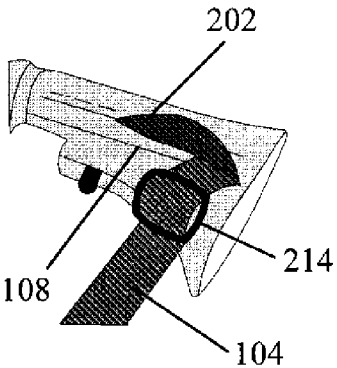
Figure 3G:
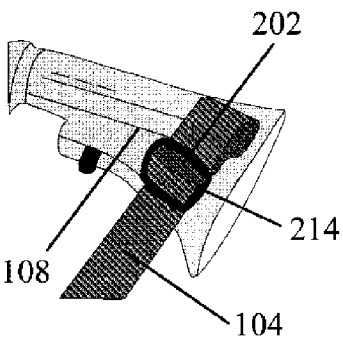
Figure 3H:
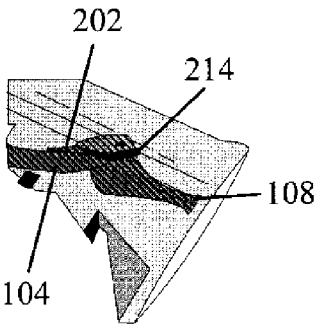

FIGS. 3*a* through 3*h* illustrate an example sequence for mounting a buttstock end 202 of a sling 104 to a rear swivel 108 of a buttstock end 106 of a firearm 102 in accordance with an embodiment of the invention. As shown in FIGS. 3*a* and 3*b* a user places the buttstock end 202 of the sling 104 through a hole 300 in the rear swivel 108 of the buttstock end 106 of firearm 102, and threads the buttstock end 202 of the sling through the hole 300. As shown in FIGS. 3*c* and 3*d*, a flat-type buckle connector such as buttstock end buckle loop 214 can be mounted to the sling 104. A free end (buttstock end 202) of the sling 104 can be looped back through the rear swivel 108 and can be threaded through the buttstock end buckle loop 214 or flat-type buckle connector, as shown in FIGS. 3*e*-3*h*. Once threaded through the buttstock end buckle loop 214, the buttstock end 202 of the sling 104 can be secured by a portion of the buttstock end buckle loop 214. In this manner, the rear or buttstock end 202 portion of the sling 104 can be mounted to the associated firearm 102.

Figure 4A:
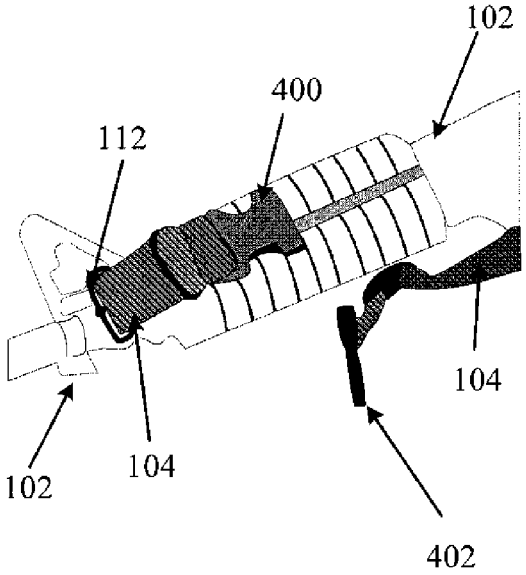
FIG. 4*a* illustrates an example removable modular release-type buckle for mounting to the sling shown in FIG. 2, with the buckle in an unmounted position, in accordance with an embodiment of the invention.
Figure 4B:
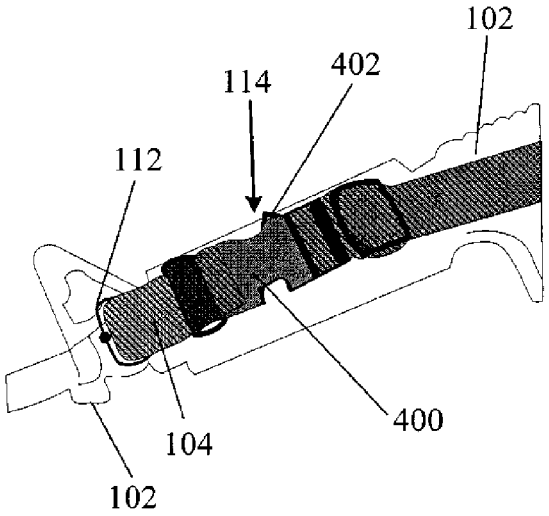
FIG. 4*b* illustrates the removable modular release-type buckle of FIG. 4*a* in a mounted position, in accordance with an embodiment of the invention.

FIG. 4*a* illustrates a perspective view of a portion of a removable modular release-type buckle, similar to 114, mounted to a forearm end 110 of a sling 104 in accordance with an embodiment of the invention. As shown in FIG. 4*a*, a female adapter portion 400 of a removable modular release-type buckle, similar to 114 in FIG. 1, such as a Fastex® Side Release Buckle, can be relatively hollow to receive a corresponding male adapter portion 402 of the removable modular release-type buckle 114. In this manner, the female adapter portion 400 can mount to the corresponding male adapter portion 402 of the removable modular release-type buckle 114. The adapter portions 400, 402 of the removable modular release-type buckle 114 can be rapidly engaged together, and the adapter portions 400, 402 of the buckle 114 are shown fully connected in FIG. 4*b*.

Figure 5:
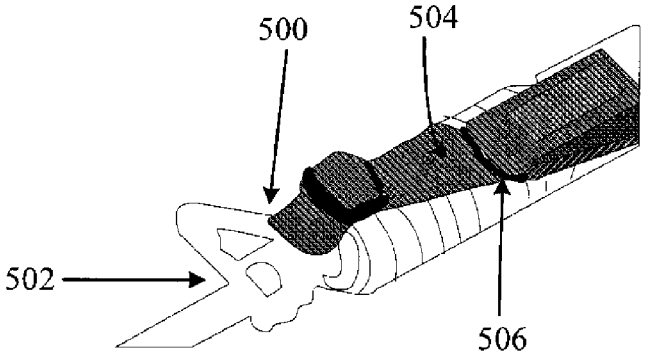
FIG. 5 is a perspective view of a forearm end of another sling shown mounted to a front swivel on an associated firearm in accordance with another embodiment of the invention.

FIG. 5 is a perspective view of a forearm end of a firearm and another sling in accordance with another embodiment of the invention. In this embodiment, a forearm end 500 of an associated firearm 502 mounts to the sling 504 shown. The sling 504 illustrated in FIG. 5 mounts to an adjuster 506 of the associated firearm 502. The extended portion of the sling 504 can be mounted to the forearm end 500 of the associated firearm 502 through use of the adjuster 506. Thus, in this embodiment, the sling 504 may be mounted adjacent to the forearm end 500 of the associated firearm 502 without a removable modular release-type buckle, similar to 114 shown in FIG. 1.

Figure 8A:
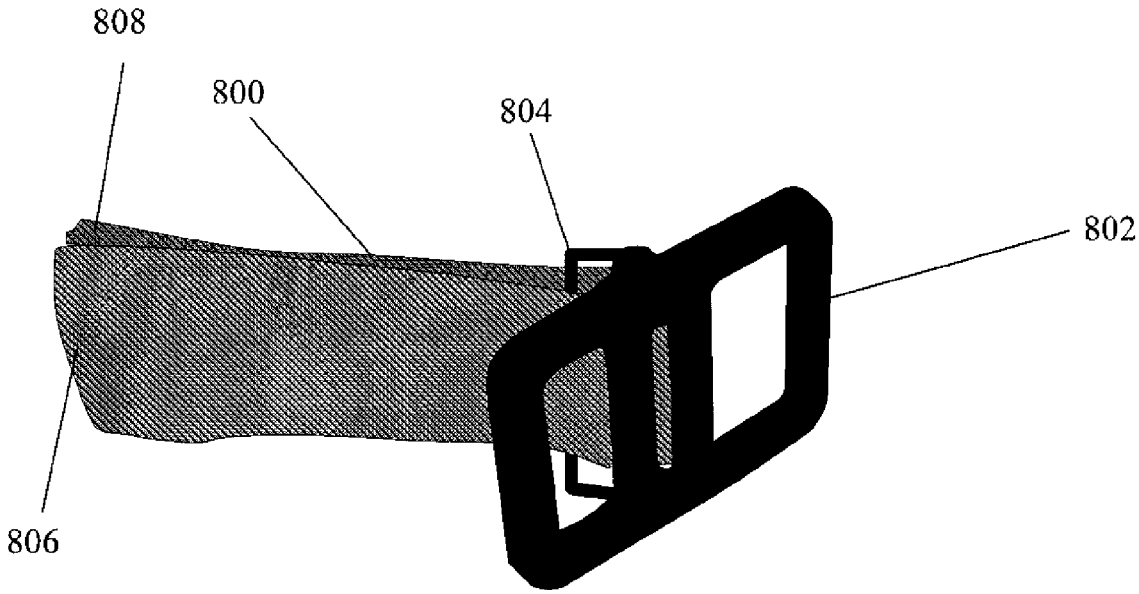
FIGS. 8*a*-*b* illustrate an example quick adjust tab and adapter for the sling shown in FIG. 1 in accordance with an embodiment of the invention.

Referring to FIGS. 8*a* and *b*, an example quick adjust tab 800 and adjuster 802 which provides a mount 804 for mounting or attachment of the quick adjust tab 800 or adjustment pull tab are shown in accordance with an embodiment of the invention. The quick adjust tab 800 shown in FIG. 8*a* can be similar to quick adjust tab 116 in FIGS. 1 and 2, and can include a portion of material, similar to the material of sling 104, that is threaded to the mount 804 of the associated adjuster 802. The mount 804 can be similar to the mount 209 in FIG. 2, and the adjuster 802 can be similar to the adjuster 118 in FIGS. 1 and 2. The adjacent ends 806, 808 of the quick adjust tab 800 can be mounted together or otherwise sewn or stitched together to facilitate a device for a user to grip at least a portion of the quick adjust tab 800 and adjust tension of the adjuster 802 and sling 104 relative to the user's body. The adjuster 802 shown in FIGS. 8*a* and 8*b* can utilize the weight of a firearm, such as 102 in FIG. 1, mounted to an associated sling, such as 104, to tension the portion of the sling 104 mounted or threaded through the adjuster 802 and to provide a friction-type lock or a mode of securing the position of the sling 104 relative to the adjuster 802. Other embodiments of a quick adjust tab 800 and adjuster 802 can provide similar or other functionality, and may have other configurations in accordance with other embodiments of the invention.

Figure 8B:
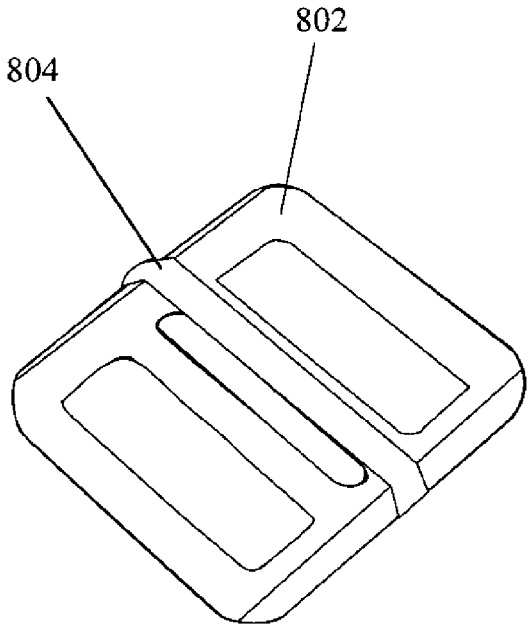

Embodiments of the quick adjust tab 800 and adjuster 802 shown in FIGS. 8*a* and 8*b* can be used with a sling to carry various types of objects including, but not limited to, a firearm, a weapon, a briefcase, luggage, or any device that may be carried by a person or a user. When a sling is implemented with a quick adjust tab 800 and adjuster 802, any object, such as a briefcase or luggage, can be carried using the sling, and the quick adjust tab 800 and adjuster 802 can similarly function and be used as described above with respect to the firearm or weapon. One will recognize the quick adjust tab 800 and adjuster 802 can be used with a sling in accordance with embodiments of the invention regardless of the type of object mounted to the sling.

FIGS. 6*a* and 6*b* illustrate respective example loosening and tightening procedures for a sling in accordance with an embodiment of the invention. In this embodiment, a sling, such as 104, is shown mounted to the firearm 102, with the firearm 102 supported by the sling 104 and positioned in front of a user 600. The sling 104 shown in FIGS. 6*a* and 6*b* extends around the user's shoulder and neck, under the user's opposing shoulder and arm, and in front of the user's body 600. In this manner, the associated firearm 102 can be supported or otherwise hang from the user's shoulder 602 or another portion of the user's body. The ability of the sling 104 to be positioned and aligned in this manner sets the sling 104 apart from conventional slings since the user 600 can rapidly adjust, move, or transition the firearm to either shoulder 602, 604 without removing or adjusting the sling 104. The user 600 can also rapidly adjust the sling 104 using at least a portion of the quick adjust tab 116 (gripped within the user's hand 604) without any entanglement or excess components of the sling 104 interfering with the user's movements. FIG. 6*a* illustrates a user 600 pulling or manipulating the quick adjust tab 116 with the user's hand 604 to adjust, or lengthen, the sling 104 while the sling 104 supports the firearm 102 from the user's body 600 or shoulder 602. FIG. 6*b* illustrates the user 600 pulling forward on the quick adjust tab 116 with the user's hand 604 to adjust, or shorten, the length of the sling 104 while the sling 104 supports the firearm 102 from the user's body 600 or shoulder 602. In both instances, the quick adjust tab 116 can remain approximately the same size whether the user 600 shortens or lengthens the sling 104, therefore, no excess component of the sling 104 can hamper the user's operation or manipulation of the firearm 102.

FIGS. 7*a* and 7*b* illustrate an example user's operation and disconnect of a removable modular release-type buckle 114 for a sling 104. Manipulation of the removable modular release-type buckle 114 can allow a user 700 to quickly remove the sling 104 in case of an emergency or combat situation. The user 702 can squeeze a portion of the removable modular release 114 on both sides simultaneously to disconnect a male adapter portion 702 from a female adapter portion 704. After the adapter portions 702, 704 of the removable modular release-type buckle 114 are disconnected, the sling 104 can be easily moved away from the user's body 700, and the user 700 may quickly remove the associated firearm from close proximity from the user's body 700.

In the manner described with respect to embodiments of the invention, relatively simple and quick object or firearm transitions can be accomplished by a user wearing the sling and associated object or firearm. In some instances, these transitions can be critical for a user in combat or hunting situations. For example, when a user lowers his or her firearm to transition to a side firearm, the firearm can be lowered to the user's weak side in a vertical orientation where the firearm can be secured, and out of the user's way to transition to the side firearm, a different firearm, or another weapon. As shown in the embodiments of FIGS. 1 and 2, an associated firearm 102 such as a M4 Carbine can be mounted to a sling 104 and carried by the user. The firearm can be supported from the user by the sling 104, and in various positions from a vertical orientation on the left side to a horizontal orientation such as a patrol position. Alternatively, the firearm 102 can be pulled around to rest on the lower back of the user with the muzzle of the firearm 102 in an upward or downward position. By using embodiments of the sling 104, the firearm 102 is readily accessible with the left hand of the user for support or aiming of the firearm 102.

Various embodiments of a sling in accordance with the invention are relatively easy to wear, to put on a user's body, and to take off the user's body, especially in an emergency or combat situation. Embodiments of this invention can make removal of an associated object or firearm from a user's body relatively easier than with conventional object or firearm slings.

While the above description contains many specifics, these specifics should not be construed as limitations on the scope of the invention, but merely as exemplifications of the disclosed embodiments. Those skilled in the art will envision many other possible variations that are within the scope of the invention.

The claimed invention is:

1. A sling system for mounting a firearm to a person's body, the system comprising:

a sling operable to mount a firearm in front of a person's body, wherein the sling comprises:

a forearm end operable to mount to a forearm end of the firearm;

a buttstock end operable to mount to a buttstock end of the firearm;

a forearm buckle loop mounted to a portion of the forearm end;

at least one adjustment loop mounted adjacent the forearm end of the firearm and formed by an overlap of a portion of the sling material;

a release buckle mounted to the sling forearm end and the at least one adjustment loop, wherein the release buckle is operable to separate the sling forearm end from the at least one adjustment loop;

an adjuster comprising a raised mount centrally located on the adjuster, wherein the adjuster is mounted to a forearm end of and operable to adjust the size of the at least one adjustment loop, wherein the adjuster changes the amount of overlap in the sling material for the at least one adjustment loop;

an intermediate buckle loop connecting the at least one intermediate adjustment loop to a portion of the sling buttstock end; and a quick adjust tab connected to the raised mount of the adjuster and operable by a user to change the size of the at least one adjustment loop when the adjuster is manipulated to any point between the forearm buckle loop and the intermediate buckle loop, wherein the size of the at least one adjustment loop and amount of overlap in the sling material of the at least one adjustment loop is increased while maintaining the firearm in front of the person's body when the quick adjust tab is grasped and pulled toward the forearm end of the object to manipulate the adjuster with respect to the at least one adjustment loop, wherein the size of the at least one adjustment loop and amount of overlap in the sling material of the at least one adjustment loop is decreased while maintaining the firearm in front of the person's body when the quick adjust tab is grasped and pulled away from the forearm end of the object, wherein the size of the at least one adjustment loop is changed by manipulation of the quick adjust tab when the sling is mounted to the person's body, wherein the length of the sling is changed by manipulation of the quick adjust tab when the sling is mounted to the person's body, and wherein the adjuster maintains the changed size of the at least one adjustment loop and length of the sling.

2. The sling system of claim 1, further comprising:

a second release buckle or connection-type device operable to connect the sling forearm end to the firearm; and a third release type buckle or connection-type device operable to connect the sling buttstock end to the firearm.

3. The sling system of claim 1, wherein the firearm comprises at least one of the following: a M-4 carbine, or a M16A2 series firearm.

4. The sling system of claim 1, wherein the person's body comprises at least one of the following: a shoulder, an arm, a torso, or a neck.

5. The sling system of claim 1, further comprising:

one or more buttstock buckle end loops operable to connect the buttstock end of the sling to the firearm.

6. A sling system for a firearm comprising:

a sling operable to mount a firearm to a portion of a person's body, the sling comprising;

a sling forearm end with a forearm buckle loop and operable to mount to a forearm end of a firearm;

an intermediate adjustment loop formed by an overlap of a portion of the sling material of the sling forearm end;

a sling buttstock end operable to mount to a buttstock end of the firearm;

a release buckle mounted to the sling forearm end and the intermediate adjustment loop, wherein the release buckle is operable to separate the sling forearm end from the intermediate adjustment loop;

a first intermediate buckle loop comprising a raised mount centrally located on the first intermediate buckle loop, wherein the first intermediate buckle loop is operable to adjust the size of the intermediate adjustment loop, wherein the first intermediate buckle loop connects the intermediate adjustment loop to a portion of the sling forearm end;

a second intermediate buckle loop connecting the intermediate adjustment loop to a portion of the sling buttstock end; and a quick adjust tab connected to the raised mount of the first intermediate buckle loop and operable by a user to change the size of the intermediate adjustment loop when the first intermediate buckle loop is manipulated to any point between the forearm buckle loop and the second intermediate buckle loop, wherein the size of the intermediate adjustment loop and amount of overlap in the sling material of the intermediate adjustment loop is increased while maintaining the firearm in front of the person's body when the quick adjust tab is grasped and pulled toward the sling forearm end to manipulate the first intermediate buckle loop with respect to the intermediate adjustment loop, and wherein the size of the intermediate adjustment loop and amount of overlap in the sling material of the intermediate adjustment loop is decreased while maintaining the firearm in front of the person's body when the quick adjust tab is grasped and pulled away from the sling forearm end, wherein the length of the sling is changed by manipulation of the quick adjust tab when the sling is mounted to the person's body; and wherein the first intermediate buckle loop maintains the changed size of the intermediate adjustment loop.

7. The sling system of claim 6, further comprising:

a second release buckle or connection-type device operable to connect the sling forearm end to the firearm.

8. The sling system of claim 6, further comprising:

a third release buckle or connection-type device operable to connect the sling buttstock end to the firearm.

9. The sling system of claim 6, wherein the firearm comprises at least one of the following: a M-4 carbine, or a M16A2 series firearm.

10. The sling system of claim 6, wherein the portion of a person's body comprises at least one of the following: a shoulder, an arm, a torso, or a neck.

11. The sling system of claim 6, further comprising:

one or more buttstock buckle end loops operable to connect the buttstock end of the sling to the firearm.

12. A sling system for a firearm comprising:

a sling operable to mount the firearm in a firing position to a portion of a person's body, wherein the sling comprises:

a forearm end operable to mount to a swivel associated with a forearm end of the firearm;

a forearm buckle loop mounted to a portion of the forearm end;

a buttstock end operable to mount to a swivel associated with a buttstock end of the firearm;

at least one adjustment loop mounted to the sling forearm end and formed by an overlap of the sling material;

a release buckle mounted to the sling forearm end and the at least one adjustment loop, wherein the release buckle is operable to separate the sling forearm end from the at least one adjustment loop;

an intermediate buckle loop comprising a raised mount centrally located on the intermediate buckle loop, wherein the intermediate buckle loop connects the at least one intermediate adjustment loop to a portion of the sling buttstock end; and a quick adjust tab connected to the raised mount, wherein the quick adjust tab is operable to change the size of the at least one adjustment loop when manipulated to any point between the forearm buckle loop and the intermediate buckle loop, wherein the size of the at least one adjustment loop and amount of overlap in the sling material of the at least one adjustment loop is increased while maintaining the firearm in front of the person's body when the quick adjust tab is grasped and pulled toward the forearm end of the firearm to manipulate the quick adjust tab with respect to the at least one adjustment loop, and further operable to change the size of the at least one adjustment loop, wherein the size of the at least one adjustment loop and amount of overlap in the sling material of the at least one adjustment loop is decreased while maintaining the firearm in front of the person's body when the quick adjust tab is grasped and pulled away from the forearm end of the firearm, wherein the size of the at least one adjustment loop can be changed by manipulation of the quick adjust tab when the sling is mounted to the person's body, wherein the length of the sling is changed by manipulation of the quick adjust tab when the sling is mounted to the person's body, and wherein the adjuster maintains the changed size of the at least one adjustment loop and the length of the sling.

13. The sling system of claim 12, wherein the portion of a person's body comprises at least one of the following: a shoulder, an arm, a torso, or a neck.

14. The sling system of claim 12, wherein the firearm comprises at least one of the following: a M-4 carbine, or a M16A2 series firearm.

15. The sling system of claim 12, further comprising:

a second release buckle or connection-type device operable to connect the sling forearm end to the firearm.

16. The sling system of claim 12, further comprising:

a third release buckle or connection-type device operable to connect the sling buttstock end to the firearm.

17. The sling system of claim 12, further comprising:

one or more buttstock buckle end loops operable to connect the buttstock end of the sling to the firearm.

* * * * *